US007885414B2

(12) United States Patent
Tsutsui et al.

(10) Patent No.: US 7,885,414 B2
(45) Date of Patent: Feb. 8, 2011

(54) BAND-SELECTABLE STEREO SYNTHESIZER USING STRICTLY COMPLEMENTARY FILTER PAIR

(75) Inventors: Ryo Tsutsui, Ibaraki (JP); Yoshihide Iwata, Ibaraki (JP); Steven D. Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 1119 days.

(21) Appl. No.: 11/560,397

(22) Filed: Nov. 16, 2006

(65) Prior Publication Data

US 2008/0118073 A1 May 22, 2008

(51) Int. Cl.
*H04R 5/00* (2006.01)

(52) U.S. Cl. ..... 381/17

(58) Field of Classification Search ..... 381/17, 381/1, 18, 310, 27, 309
See application file for complete search history.

(56) References Cited

U.S. PATENT DOCUMENTS

| | | | | |
|---|---|---|---|---|
| 6,175,631 | B1 * | 1/2001 | Davis et al. | 381/17 |
| 6,771,778 | B2 * | 8/2004 | Kirkeby | 381/17 |
| 2006/0029231 | A1 * | 2/2006 | Henn et al. | 381/1 |

* cited by examiner

*Primary Examiner*—Curtis Kuntz
*Assistant Examiner*—Hai Phan
(74) *Attorney, Agent, or Firm*—Robert D. Marshall, Jr.; W. James Brady; Frederick J. Telecky, Jr.

(57) ABSTRACT

A new method is proposed that produces stereophonic sound image out of monaural signal within a selected frequency regions. The system employs a strictly complementary (SC) linear phase FIR filter pair that separates input signal into different frequency regions. A pair of comb filters is applied to one of the filter's output. This implementation allows a certain frequency range to be relatively localized at center while the other sounds are perceived in a wider space.

7 Claims, 3 Drawing Sheets

BAND-SELECTABLE STEREO SYNTHESIZER USING STRICTLY COMPLEMENTARY FILTER PAIR

CROSS REFERENCE TO RELATED APPLICATIONS

This application is related to contemporaneously filed U.S. patent application Ser. No. 11/560,387 LOW COMPUTATION MONO TO STEREO CONVERSION USING INTRA-AURAL DIFFERENCES and U.S. patent application Ser. No. 11/560,390 STEREO SYNTHESIZER USING COMB FILTERS AND INTRA-AURAL DIFFERENCES.

TECHNICAL FIELD OF THE INVENTION

The technical field of this invention is stereo synthesis from monaural input signals.

BACKGROUND OF THE INVENTION

When listening to sounds that are from in a monaural source, widening the sound image using a stereo synthesizer in the entire frequency range doesn't always satisfy listeners' preference. For example, the vocal of a song would be best if localized at center. Conventional stereo synthesis does not do this.

SUMMARY OF THE INVENTION

This invention uses strictly complementary linear phase FIR filters to separate the incoming audio signal into at least two frequency regions. Stereo synthesis is performed at less than all of these frequency regions.

This invention uses any magnitude response curve for the band separation filter. This enables selection of one frequency band or multiple frequency bands on which to perform stereo synthesis. This is different from conventional methods which just widen the monaural signal in the entire frequency region or just places the crossover frequencies at the formant frequencies of the human voice.

This invention let a certain instrument or vocal sound be localized at center, while the other instruments are perceived in wider sound space.

BRIEF DESCRIPTION OF THE DRAWINGS

These and other aspects of this invention are illustrated in the drawings, in which.

DETAILED DESCRIPTION OF PREFERRED EMBODIMENTS

A monaural audio signal is perceived at the center of a listener's head in a binaural system and at the midpoint of two loudspeakers in two loudspeaker systems. A stereo synthesizer produces a simulated stereo signal from the monaural signal so that the sound image becomes ambiguous and thus wider. This widened sound image is often preferred to a plain monaural sound image.

A lot of work has been done on stereo synthesizers. The technique that is commonly employed is to delay the monaural signal and add to/subtract from the original signal. From a digital signal processing standpoint, this is called a comb filter due to its frequency response. When allocating notches of the comb filter onto different frequencies for left and right channels, the outputs from both channels become uncorrelated. This causes the sound image to be ambiguous and accordingly wider than just listening to the monaural signal.

The comb filter solution works well for producing a wider sound image from a monaural signal. However, just widening the total sound sometimes causes a problem. When listening to pop music, listeners generally expect the vocal be localized at the center. The other instruments are expected to be in the stereophonic sound image. This preference is quite similar to many multichannel speaker systems which have a center speaker that centralizes human voices.

To overcome the problem, one example of this invention separates the incoming monaural signal into two frequency regions using a pair of strictly complementary (SC) linear phase finite impulse response (FIR) filters. The invention applies a comb filter stereo synthesizer to just one of the two frequency regions. This invention uses SC linear phase FIR filters is because of the low computational cost. This invention does not need to implement synthesis filters that reconstruct the original signal. This invention needs to calculate only one of the filter outputs, because the other filter output can be calculated from the difference between the input signal and the calculated filter output.

For the particular problem of centralizing the voice signal, the frequency separation should be achieved with band pass and band stop filters. The pass band and stop band are placed at the voice band. However, this invention is not limited to band pass and band stop filters. Any type of filter pair such as low pass and high pass are applicable depending on which frequency regions desired to be in or out of the stereo synthesis. This depends upon the instrument(s) to be centralized. This flexibility makes this invention more attractive than the prior art method which just places the crossover frequencies at the formant frequencies of the human voice.

Figure 1:
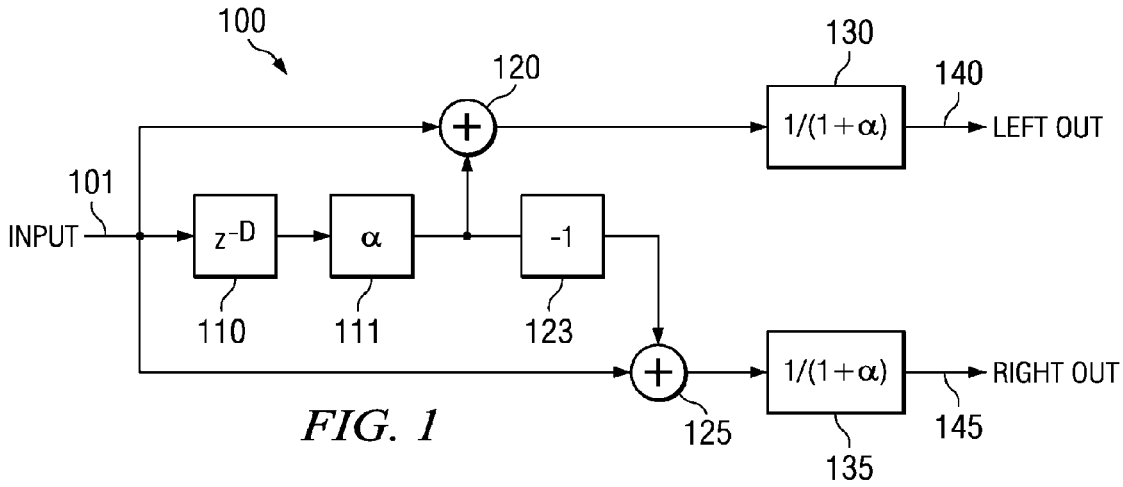
FIG. 1 is a block diagram of comb filters used in stereo synthesis in this invention.

Stereo synthesis is typically achieved using FIR comb filters. These comb filters are embodied by adding a delayed weighted signal to the original signal. FIG. 1 illustrates a block diagram of such a system 100. Input signal 101 is delayed in delay block 110. Gain block 111 controls the amount $\alpha$ of the delayed signal supplied to one input of adder 120. The other input of adder 120 is the original input signal 101. Gain adjustment block 130 recovers the original signal level. This sum signal is the left channel output 140. Inverter 123 inverts the delayed weighted signal from gain block 111. This inverted signal forms one input to adder 125. The other input to adder 125 is the original input signal 101. Gain adjustment block 135 recovers the original signal level. This difference signal forms right channel output 145. Let $C_0(z)$ and $C_1(z)$ denote the transfer functions for left and right channels, respectively, then:

$$C_0(z)=(1+\alpha z^{-D})/(1+\alpha)$$

$$C_1(z)=(1-\alpha z^{-D})/(1+\alpha) \quad (1)$$

where: D is a delay that controls the stride of the notches of the comb; and $\alpha$ controls the depth of the notches, where typically $0<\alpha\leqq 1$. The magnitude responses are given by:

$$|C_0(e^{-j\omega})| = \sqrt{1-\frac{4\alpha}{(1+\alpha)^2}\sin^2\frac{\omega D}{2}} \quad (2)$$

$$|C_1(e^{-j\omega})| = \sqrt{1-\frac{4\alpha}{(1+\alpha)^2}\cos^2\frac{\omega D}{2}}$$

Equation (2) shows that both filters have peaks and notches with constant stride of $2\pi/D$. The peak of one filter is placed at the notches of the other filter and vice versa. These responses de-correlate the output channels. The sound image becomes ambiguous and thus wider.

Figure 2:
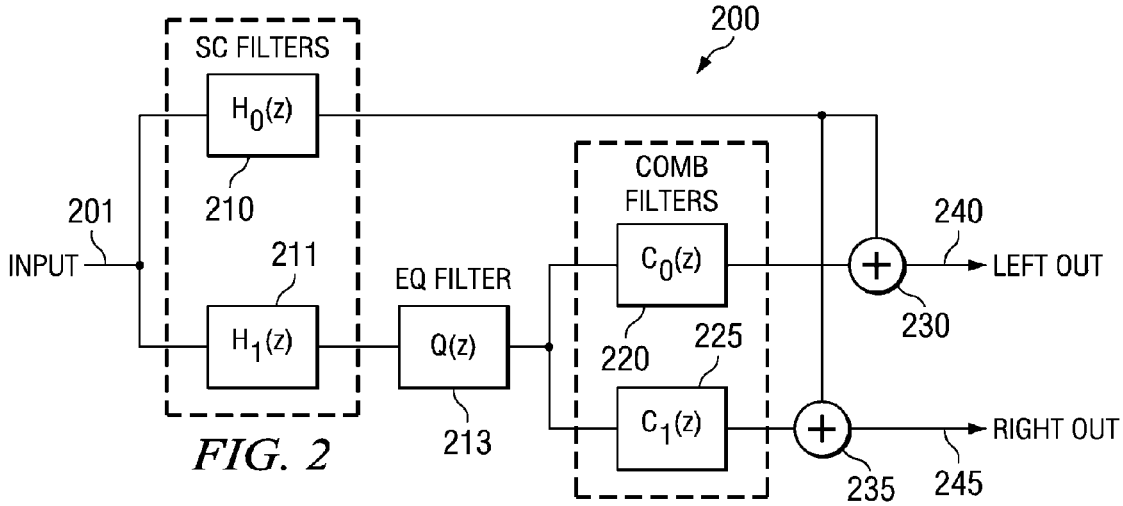
FIG. 2 illustrates a block diagram of the system of this invention.

FIG. 2 illustrates the block diagram of the stereo synthesizer of this invention. Input signal 201 is supplied to a pair of strictly complementary (SC) filters $H_0(z)$ 210 and $H_1(z)$ 211. This separates the incoming monaural signal into two frequency regions. The output of filter $H_0(z)$ 210 supplies one input of left channel adder 230 and one input of right channel adder 235. Because the frequencies passed by filter $H_0(z)$ 210 appear equally in the left channel output 240 and the right channel output 245, these frequencies are localized in the center. Only the output from filter $H_1(z)$ 211 is processed with the comb filters 220 and 225. The output of comb filter 220 supplies the second input of left channel adder 230. The output of comb filter 225 supplies the second input of right channel adder 235. Therefore the simulated stereo sound is created only in the pass band of $H_1(z)$.

The equalization (EQ) filter 213 Q(z) may be optionally inserted in order to compensate for the harmony that might be distorted by the notches of the comb filters. Since EQ filter 213 doesn't affect the sound image wideness, but just the sound quality it will not be described in detail.

The output of strictly complementary (SC) finite impulse response (FIR) filters 210 and 211 are as follows:

$$\sum_{m=0}^{M-1} H_m(z) = cz^{N_0} \quad (3)$$

For the example of FIG. 2, M=2 and c=1. Adding the all filter outputs perfectly reconstructs the original signal. Thus no synthesis filter is needed. The final filter output can be produced by subtracting the other filter outputs from the original input signal. If $H_m(z)$ is a linear phase FIR whose order N is even number and if $N_0=N/2$, then equation (3) can be rewritten as:

$$H_1(e^{-j\omega})=z^{-N/2}-H_0(e^{-j\omega}) \quad (4)$$

But since $H_0(z)$ is linear phase, the frequency response can be written as:

$$H_1(e^{-j\omega})=e^{-j\omega N/2}(1-|H_0(e^{-j\omega})|) \quad (5)$$

From equation (5), it is clear that:

$$|H_1(e^{-j\omega})|=1-|H_0(e^{-j\omega})| \quad (6)$$

For example, if $H_0(z)$ is band pass filter, then $H_1(z)$ will be band stop filter.

From the computational cost viewpoint, equation (4) suggests the benefit from using the SC linear phase FIR filters. The output from $H_0(z)$ can be calculated by letting $h_0(n)$ be the impulse response as follows:

$$y_0(n) = \sum_{i=0}^{N} h_0(i)x(n-i) \quad (7)$$

Then the other filter output can be calculated as follows:

$$y_1(n)=x(n-N/2)-y_0(n) \quad (8)$$

Thus the major computational cost will be for calculating only one filter output.

Figure 3A:
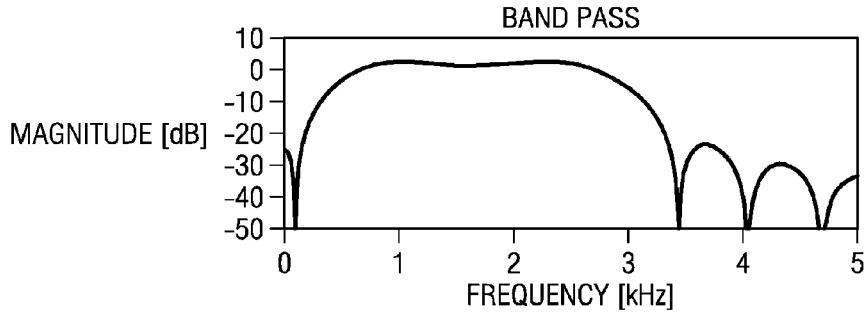
FIGS. 3A and 3B together illustrate the magnitude responses of the strictly complementary filters employed in this invention.
Figure 3B:
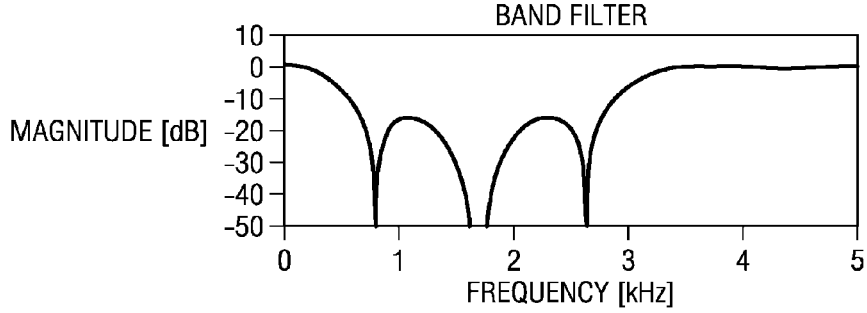

The following will describe an example stereo synthesizer according to this invention. The input was sampled at a frequency of 44.1 kHz. The first SC FIR filters is an order 64 FIR band pass filter $H_0(z)$ based on a least square error prototype. The cutoff frequencies were chosen to be 0.5 kHz and 3 kHz. This frequency range covers lower formant frequencies of the human voice. The complementary filter $H_1(z)$ was calculated according to equation (4). FIG. 3 illustrates the magnitude response of the band pass filter $H_0(z)$ (FIG. 3A) and the band stop filter $H_1(z)$ (FIG. 3B).

Figure 4A:
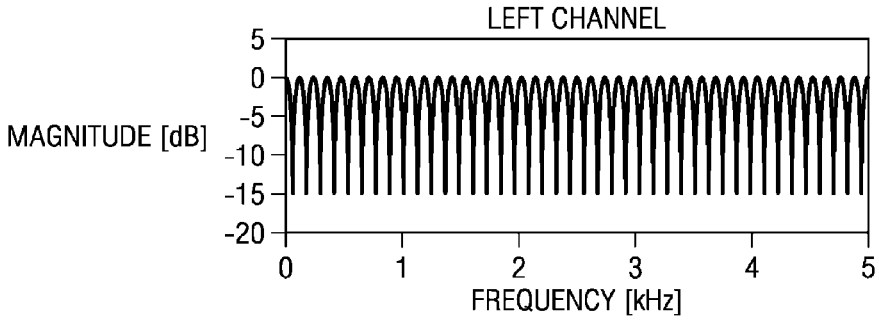
FIGS. 4A and 4B together illustrate the magnitude responses of the comb filters of this invention.
Figure 4B:
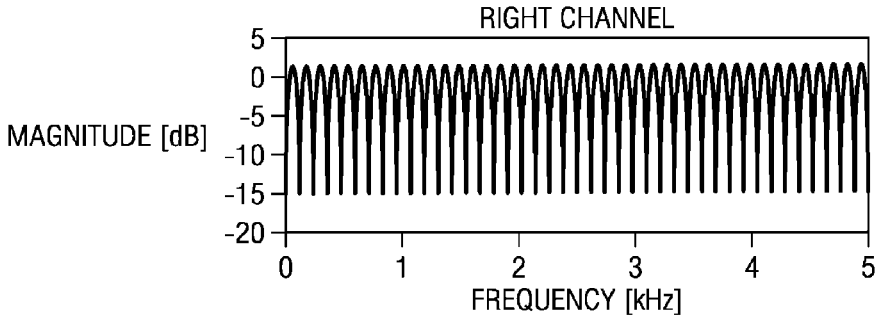
Figure 5A:
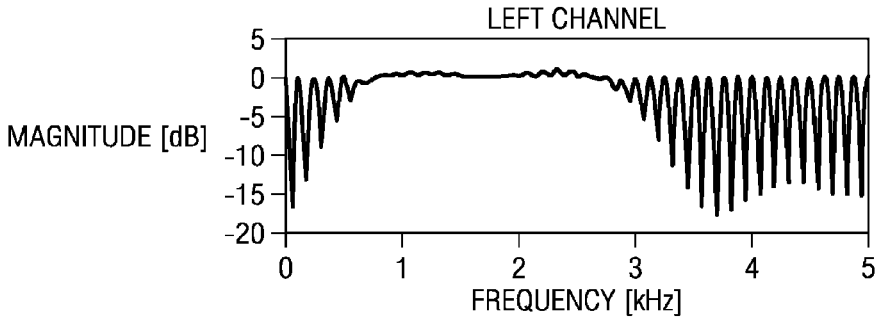
FIGS. 5A and 5B together illustrate the magnitude response of the combination of the combined strictly complementary filters and comb filters of this invention.
Figure 5B:
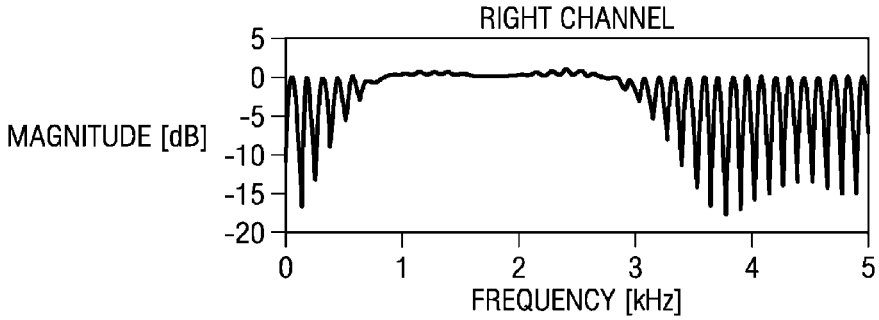

For the comb filters: $\alpha$ was selected as 0.7; and D was selected as 8 mSec. This delay D implies a filter of 352 taps. FIG. 4 illustrates the magnitude response of the respective left channel comb filter 220 (FIG. 4A) and right channel comb filter 225 (FIG. 4B). FIG. 5 illustrates the magnitude response of the combination of the SC filters 210 and 122 and comb filters 220 and 225 for the left channel (FIG. 5A) and for the right channel (FIG. 5B). This is equivalent to the block diagram shown in FIG. 2 without equalization filter 213. Comparing FIGS. 4 and 5 shows that the SC filter reduces the notch depth of the comb in the pass band of the band pass filter $H_0(z)$ in the frequency range between 0.5 kHz and 3 kHz from 15 dB to 1 dB. This justifies employing the SC filter in the stereo synthesizer.

Figure 6A:
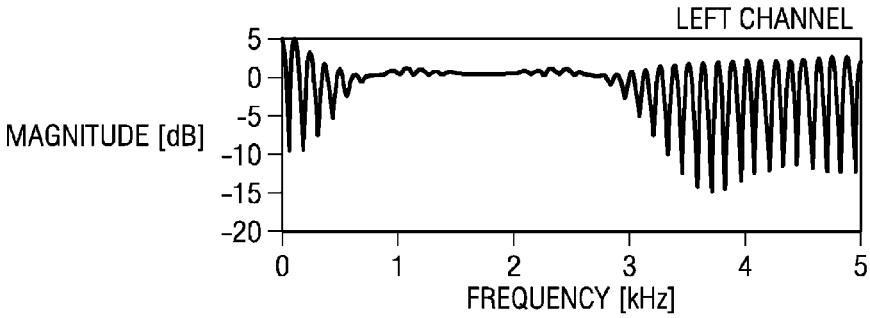
FIGS. 6A and 6B together illustrate the magnitude response of the system of FIG. 2 after integrating equalization filters.
Figure 6B:
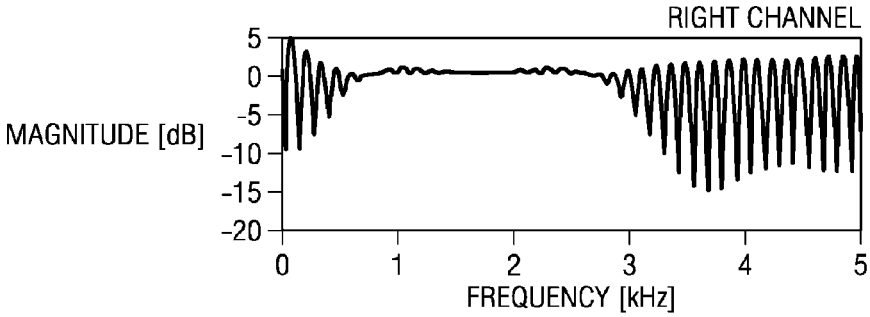

In this example equalization filter 213 includes first order low and high shelving filters that boost the low and high frequency sound. This achieves better sound quality. In this example the equalization filter 213 includes a low shelving gain of 6 dB at the band edge 0.3 kHz and a high shelving gain of 6 dB at the band edge 6 kHz. FIG. 6 illustrates the respective left channel (FIG. 6A) and right channel (FIG. 6B) magnitude responses.

A brief listening tests on the stereo synthesizer of this example results in centralization of everything around the range between 0.5 kHz and 3 kHz. In the listening test this included the vocal sounds. However, the sound image was widened in the other frequency ranges. Therefore this example stereo synthesizer can relatively centralize the voice sound. This confirmed realization of the object of this example of simulating stereo sound while centralizing the voice band.

Figure 7:
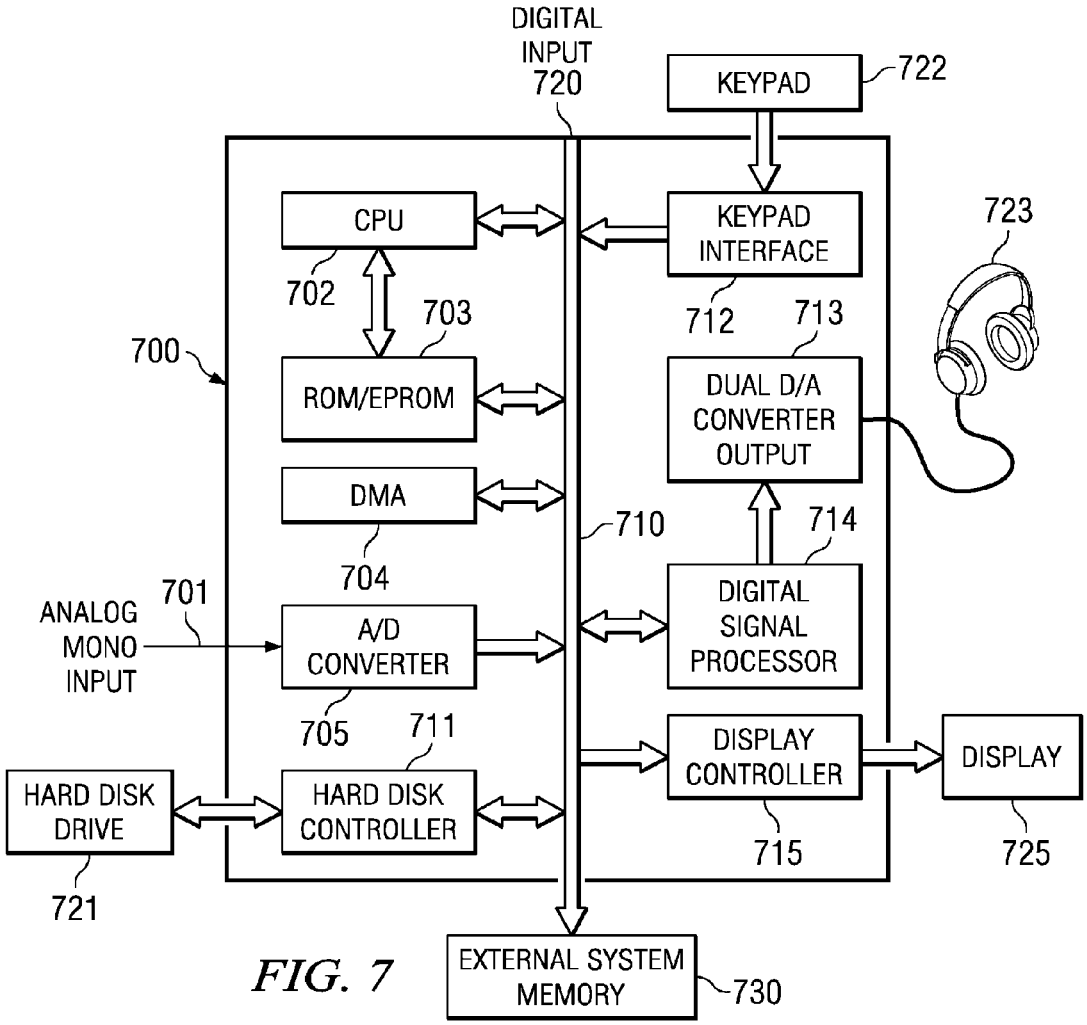
FIG. 7 illustrates a portable music system such as might use this invention.

FIG. 7 illustrates a block diagram of an example consumer product that might use this invention. FIG. 7 illustrates a portable compressed digital music system. This portable compressed digital music system includes system-on-chip integrated circuit 700 and external components hard disk drive 721, keypad 722, headphones 723, display 725 and external memory 730.

The compressed digital music system illustrated in FIG. 7 stores compressed digital music files on hard disk drive 721. These are recalled in proper order, decompressed and presented to the user via headphones 723. System-on-chip 700 includes core components: central processing unit (CPU) 702; read only memory/erasable programmable read only memory (ROM/EPROM) 703; direct memory access (DMA) unit 704; analog to digital converter 705; system bus 710; and digital input 720. System-on-chip 700 includes peripherals components: hard disk controller 711; keypad interface 712; dual channel (stereo) digital to analog converter and analog output 713; digital signal processor 714; and display controller 715. Central processing unit (CPU) 702 acts as the controller of the system giving the system its character. CPU 702 operates according to programs stored in ROM/EPROM 703. Read only memory (ROM) is fixed upon manufacture. Suitable programs in ROM include: the user interaction programs that control how the system responds to inputs from keypad 712 and displays information on display 725; the manner of fetching and controlling files on hard disk drive 721 and the like. Erasable programmable read only memory (EPROM) may be changed following manufacture even in the hand of the consumer in the field. Suitable programs for storage in EPROM include the compressed data decoding routines. As an example, following purchase the consumer may desire to enable the system to be capable of employing compressed digital data formats different from or in addition to the initially enabled formats. The suitable control program is loaded into EPROM from digital input 720 via system bus 710. Thereafter it may be used to decode/decompress the additional data format. A typical system may include both ROM and EPROM.

Direct memory access (DMA) unit 704 controls data movement throughout the whole system. This primarily includes movement of compressed digital music data from hard disk drive 721 to external system memory 730 and to digital signal processor 714. Data movement by DMA 704 is controlled by commands from CPU 702. However, once the commands are transmitted, DMA 704 operates autonomously without intervention by CPU 702.

System bus 710 serves as the backbone of system-on-chip 700. Major data movement within system-on-chip 700 occurs via system bus 710.

Hard drive controller 711 controls data movement to and from hard drive 721. Hard drive controller 711 moves data from hard disk drive 721 to system bus 710 under control of DMA 704. This data movement would enable recall of digital music data from hard drive 721 for decompression and presentation to the user. Hard drive controller 711 moves data from digital input 720 and system bus 710 to hard disk drive 721. This enables loading digital music data from an external source to hard disk drive 721.

Keypad interface 712 mediates user input from keypad 722. Keypad 722 typically includes a plurality of momentary contact key switches for user input. Keypad interface 712 senses the condition of these key switches of keypad 722 and signals CPU 702 of the user input. Keypad interface 712 typically encodes the input key in a code that can be read by CPU 702. Keypad interface 712 may signal a user input by transmitting an interrupt to CPU 702 via an interrupt line (not shown). CPU 702 can then read the input key code and take appropriate action.

Dual digital to analog (D/A) converter and analog output 713 receives the decompressed digital music data from digital signal processor 714. This provides a stereo analog signal to headphones 723 for listening by the user. Digital signal processor 714 receives the compressed digital music data and decompresses this data. There are several known digital music compression techniques. These typically employ similar algorithms. It is therefore possible that digital signal processor 714 can be programmed to decompress music data according to a selected one of plural compression techniques.

Display controller 715 controls the display shown to the user via display 725. Display controller 715 receives data from CPU 702 via system bus 710 to control the display. Display 725 is typically a multiline liquid crystal display (LCD). This display typically shows the title of the currently playing song. It may also be used to aid in the user specifying playlists and the like.

External system memory 730 provides the major volatile data storage for the system. This may include the machine state as controlled by CPU 702. Typically data is recalled from hard disk drive 721 and buffered in external system memory 730 before decompression by digital signal processor 714. External system memory 730 may also be used to store intermediate results of the decompression. External system memory 730 is typically commodity DRAM or synchronous DRAM.

The portable music system illustrated in FIG. 7 includes components to employ this invention. An analog mono input 701 supplies a signal to analog to digital (A/D) converter 705. A/D converter 705 supplies this digital data to system bus 710. DMA 704 controls movement of this data to hard disk 721 via hard disk controller 711, external system memory 730 or digital signal processor 714. Digital signal processor is preferably programmed via ROM/EPROM 703 to apply the stereo synthesis of this invention to this digitized mono input. Digital signal processor 714 is particularly adapted to implement the filter functions of this invention for stereo synthesis. Those skilled in the art of digital signal processor system design would know how to program digital signal processor 714 to perform the stereo synthesis process described in conjunction with FIGS. 1 and 2. The synthesized stereo signal is supplied to dual D/A converter and analog output 713 for the use of the listener via headphones 723. Note further that a mono digital signal may be delivered to the portable music player via digital input for storage in hard disk drive 721 or external memory 730 or direct stereo synthesis via digital signal processor 714.

What is claimed is:

1. A method of synthesizing stereo sound from a monaural sound signal comprising the steps of:

band stop filtering the monaural sound signal having a predetermined stop band;

producing first and second decorrelated band stop filtered signals by filtering an input with respective first and second complementary comb filters, wherein frequency peaks of said first comb filter matches frequency notches of said second comb filter and frequency notches of said first comb filter matches frequency peaks of said second comb filter, said first comb filter having a transfer function $C_0(z)$ calculated by $$C_0(z)=(1+\alpha z^{-D})/(1+\alpha), \text{ and}$$

said second comb filter having a transfer function $C_1(z)$ calculated by $$C_1(z)=(1-\alpha z^{-D})/(1+\alpha)$$

where:

z is an input variable; D is a delay factor; and $\alpha$ is a scaling factor;

band pass filtering the monaural sound signal having a predetermined pass band, said predetermined band pass being equal to said predetermined stop band;

summing said band pass filtered monaural sound signal and said first decorrelated band stop filtered signal to produce a first stereo output signal; and summing said band pass filtered monaural sound signal and said second decorrelated band stop filtered signal to produce a second stereo output signal.

2. The method of claim 1, wherein;

the delay D is 8 mS; and the scaling factor $\alpha$ is within the range $0<\alpha\leqq 1$.

3. The method of claim 1, further comprising:

equalization filtering said band stop filtered monaural sound signal before said first and second complementary comb filters to compensate for the harmony that might be distorted by the notches of said comb filters.

4. The method of claim 3, wherein:

said step of equalization filtering consists of includes a low shelving gain of 6 dB at a band edge below the lower band edge of said predetermined stop band and a high shelving gain of 6 dB at a band edge above the upper band edge of said predetermined stop band.

5. The method of claim 1, wherein:

said steps of band stop filtering the monaural sound signal and band pass filtering the monaural sound signal comprises using strict complementary (SC) linear phase finite impulse response (FIR) filters.

6. A method of synthesizing stereo sound from a monaural sound signal comprising the steps of:

band stop filtering the monaural sound signal having a predetermined stop band;

equalization filtering said band stop filtered monaural sound signal to compensate for the harmony that might be distorted by the notches of said comb filters;

producing first and second decorrelated band stop filtered signals by filtering the equalization filtered band stop filtered monaural sound signal with respective first and second complementary comb filters, wherein frequency peaks of said first comb filter matches frequency notches of said second comb filter and frequency notches of said first comb filter matches frequency peaks of said second comb filter, said first comb filter having a filter function $C_0(z)$ calculated by $$C_0(z)=(1+\alpha z^{-D})/(1+\alpha), \text{ and}$$

said second comb filter having a filter function $C_1(z)$ calculated by $$C_1(z)=(1-\alpha z^{-D})/(1+\alpha)$$

where:

z is an input variable; D is a delay factor; and $\alpha$ is a scaling factor;

band pass filtering the monaural sound signal having a predetermined pass band, said predetermined band pass being equal to said predetermined stop band;

summing said band pass filtered monaural sound signal and said first decorrelated band stop filtered signal to produce a first stereo output signal; and summing said band pass filtered monaural sound signal and said second decorrelated band stop filtered signal to produce a second stereo output signal.

7. The method of claim 6, wherein:

said step of equalization filtering consists of includes a low shelving gain of 6 dB at a band edge below the lower band edge of said predetermined stop band and a high shelving gain of 6 dB at a band edge above the upper band edge of said predetermined stop band.

* * * * *